US005857235A

United States Patent [19]

Morris

[11] Patent Number: 5,857,235

[45] Date of Patent: Jan. 12, 1999

[54] PAINT APPLICATOR

[76] Inventor: Stephen E. Morris, 4606 Ryehill Dr., Joliet, Ill. 60431

[21] Appl. No.: 876,795

[22] Filed: Jun. 16, 1997

[51] Int. Cl.[6] ..... B05C 17/12

[52] U.S. Cl. ..... 15/223; 15/209.1; 15/210.5; 15/244.3; 118/264; 401/28; 401/268

[58] Field of Search ..... 15/208, 209.1, 15/210.1, 210.5, 215, 217, 219, 220.1, 221, 223, 224, 226, 244.3; 101/327, 368; 401/28, 200, 268; 118/264

[56] References Cited

U.S. PATENT DOCUMENTS

| | | | |
|---|---|---|---|
| 759,155 | 5/1904 | Burt et al. | 15/224 |
| 768,715 | 8/1904 | Worcester | 15/224 |
| 1,811,372 | 6/1931 | Taylor | 15/210.5 |
| 2,597,772 | 5/1952 | Bongiovanni | 15/226 |
| 4,996,735 | 3/1991 | Blankenship | 15/210.1 |
| 5,626,672 | 5/1997 | Rossetti | 15/230.11 X |

FOREIGN PATENT DOCUMENTS

| | | | |
|---|---|---|---|
| 1405 | 7/1932 | Australia | 15/210.5 |
| 45670 | 1/1911 | Austria | 15/210.5 |
| 351134 | 4/1922 | Germany | 15/210.5 |
| 419712 | 10/1925 | Germany | 15/210.5 |
| 332407 | 7/1930 | United Kingdom | 15/210.5 |
| 526246 | 9/1940 | United Kingdom | 15/210.5 |
| 643623 | 9/1950 | United Kingdom | 15/210.5 |

*Primary Examiner*—Mark Spisich
*Attorney, Agent, or Firm*—Ernest Kettelson

[57] ABSTRACT

An applicator for creating designs, patterns and configurations in the paint or other material being applied to a surface area, comprising a body portion for the user to hold and a working portion to apply the paint or other material to the surface area. The working portion includes a plurality of absorbent flexible sheet cup members or pods, having radially extending folds which flare outwardly to the outer free end. A thread is drawn through the radial folds at the outer free end portion of each cup member or pod which has been folded over around the outer circumference. The thread is drawn up to bring the radial folds together in close side-by-side relationship, giving a patterned or textured outer free end surface to the working portion of the applicator. A restricting band is drawn up relatively tighter around the mid-section of each cup member or pod about midway between the outer free end and the lower end which is secured to the body portion. A narrowed or restricted passageway is then provided between the outer end portion of each cup member or pod and the lower chamber portion attached to the body portion. The lower chamber portion of each pod or cup member fills with paint when the applicator is dipped into a paint container. The paint is dispensed in a limited controlled manner through the restricted passageway to the surface being painted when the painter brushes and presses the applicator against the surface being painted.

8 Claims, 4 Drawing Sheets

PAINT APPLICATOR

FIELD OF THE INVENTION

This invention relates to the field of applicators for applying paint and other materials to walls and other surfaces. In particular it relates to applicators which enable the user to apply a design or configuration of some kind when the paint or other material is applied.

BACKGROUND OF THE INVENTION

Prior art devices in this field of which the inventor is aware include those disclosed in the following U.S. patents:

U.S. Pat. No. 5,378,419
5,206,979
4,930,179
4,257,140
3,669,069
1,811,372
1,789,627
1,700,079
1,121,272
589,467

Copies of these patents are readily available in a number of public libraries and from the Patent and Trademark Office, as well as from various sources on the Internet.

SUMMARY OF THE INVENTION

The applicator in accordance with the present invention is an improvement over prior art devices. One commonly used prior art method of making a design, a pattern or configuration of some kind in the paint as it is being applied to the wall is to use a rag, crumple it up in the user's hand, dip into the paint in a container to soak up the rag with paint and then apply it to the wall or other surface in such a way that it creates a pattern, or design or other configuration which makes the painted wall resemble wall paper having a comparable pattern, design or configuration.

In accordance with the present invention, an applicator is provided which has a body portion for a user to grasp in his hand and a working portion for dipping into the paint or other material which creates a design, pattern or other configuration in the paint when applied to the wall, comparable to the design, patterns and configurations that are created by more primitive and difficult to use prior art methods.

The working portion of the applicator in accordance with the present invention includes a plurality of fabric pods having closely gathered folds, secured at their lower ends to the body portion in relatively tight side-by-side relationship. The folds of these fabric pods flare outwardly as they extend upwardly from a peripheral band of thread or string around the mid-section of the pods. The pods terminate upwardly in an outwardly flared free end.

The pods are made by cutting a piece of fabric into a circle having a diameter of about six inches. The outer circumferential edge is folded over and gathered into radial folds. A needle then brings a thread through the radially extending folds of the circumferentially folded over portion. The result is to form the circular piece of fabric into a cup.

A restrictive band of thread or string is then drawn around a mid-section portion of the fabric cup member or pod, to draw it up relatively tight around the mid-section. A restrictive small diameter passageway is thus formed through the mid-section of the cup member or pod from its outwardly flared free end and opening to the lower chamber portion of the cup member between the location of the peripheral band and the lower end of each cup member or pod that is secured to the body portion of the applicator. The cross-sectional dimension of the lower chamber portion of the cup member or pods is greater than that of the restricted passageway. The larger cross-section lower chamber portion absorbs paint through the absorbent fabric wall when dipped into a paint supply container as well as through the narrowed or restricted passageway. This lower chamber of each cup member or pod serves as a reservoir to receive and hold a relatively larger amount of paint than the fabric alone could absorb when dipped into a paint container. Paint is then dispersed slowly and in a controlled manner from the lower chamber reservoir of each cup or pod through the restricted passageway when the painter applies pressure as paint is being applied to a surface area.

The radial and circumferential folds at the outer free end of each cup member or pod enable the painter to create a design or pattern as he brushes the applicator against and across the surface area being painted.

Other improved features and advantages of the applicator in accordance with this invention will be apparent from the more detailed description which follows and from the accompanying drawing.

DESCRIPTION OF PREFERRED EMBODIMENT

Figure 1:
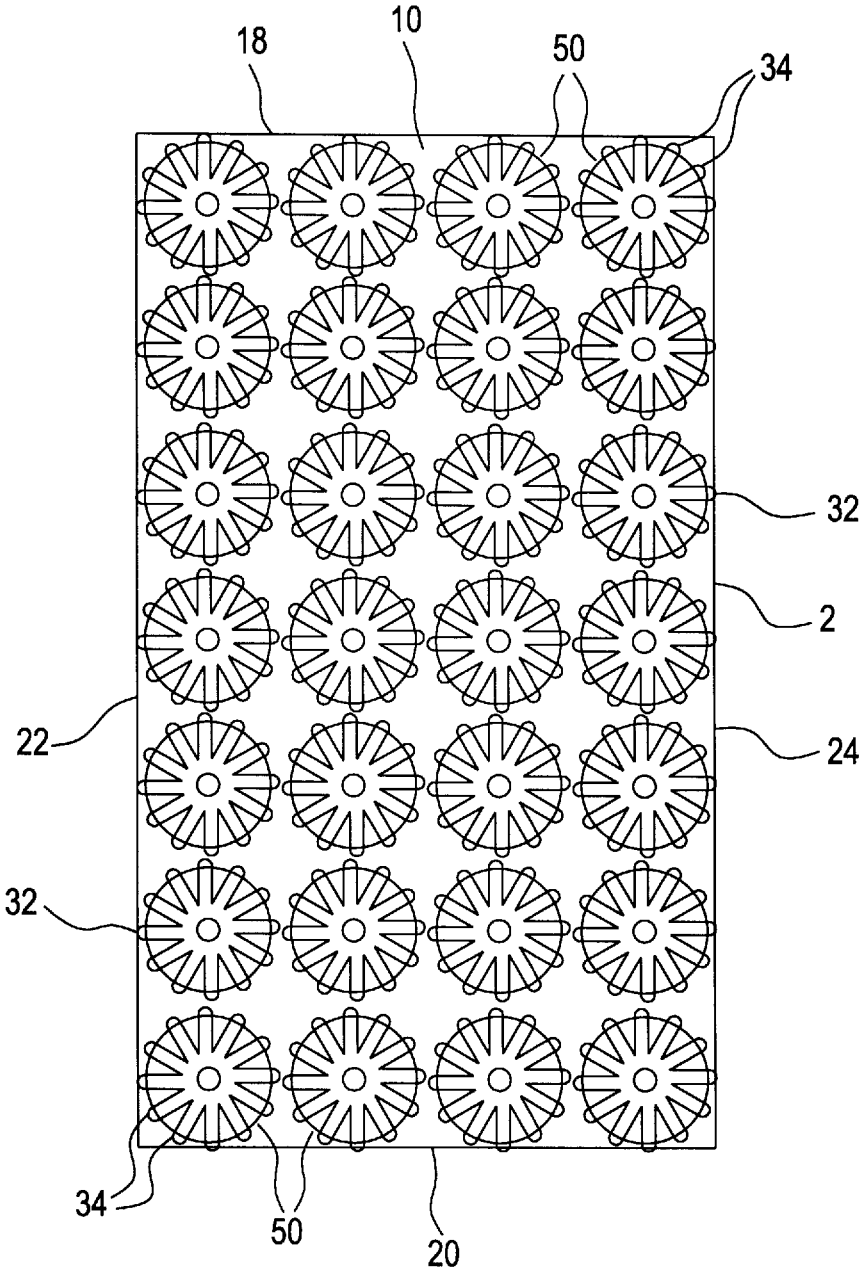
FIG. 1 is a top plan view of a paint applicator in accordance with this invention.
Figure 3:
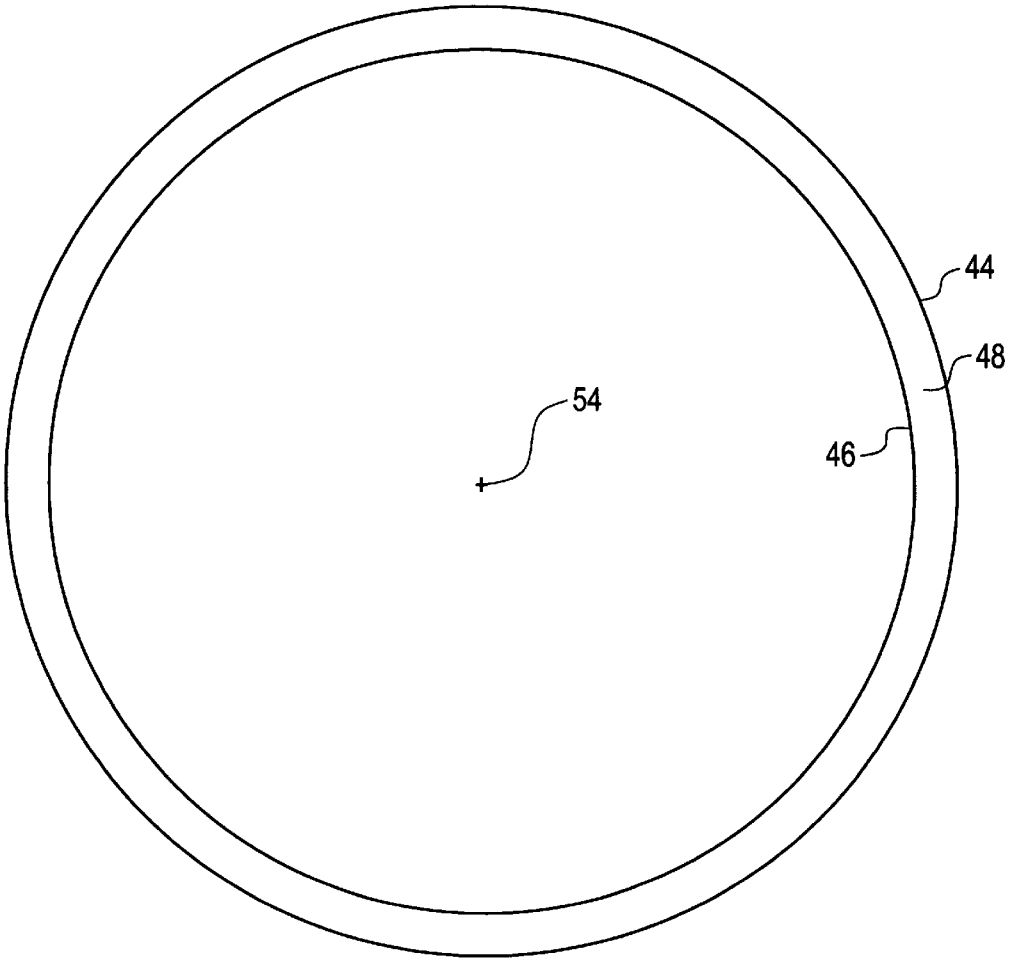
FIG. 3 is a plan view of a circular piece of fabric from which the cups or pods having radial folds therein are made for securing to the body portion of the applicator in accordance with this invention to make up the working portion of the applicator.
Figure 2:
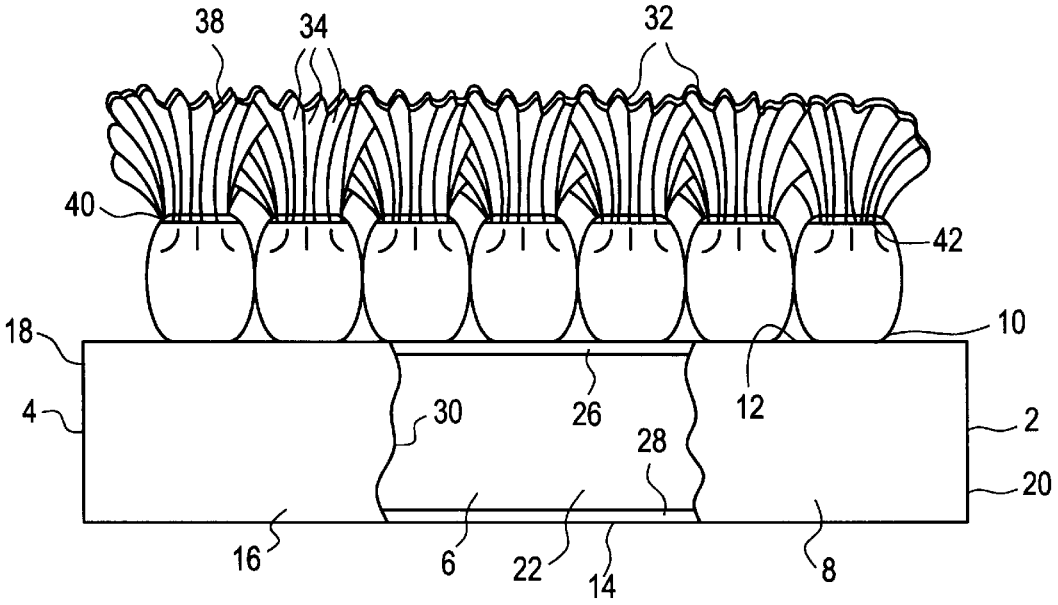
FIG. 2 is a side elevation view of the applicator shown in FIG. 1.
Figure 4:
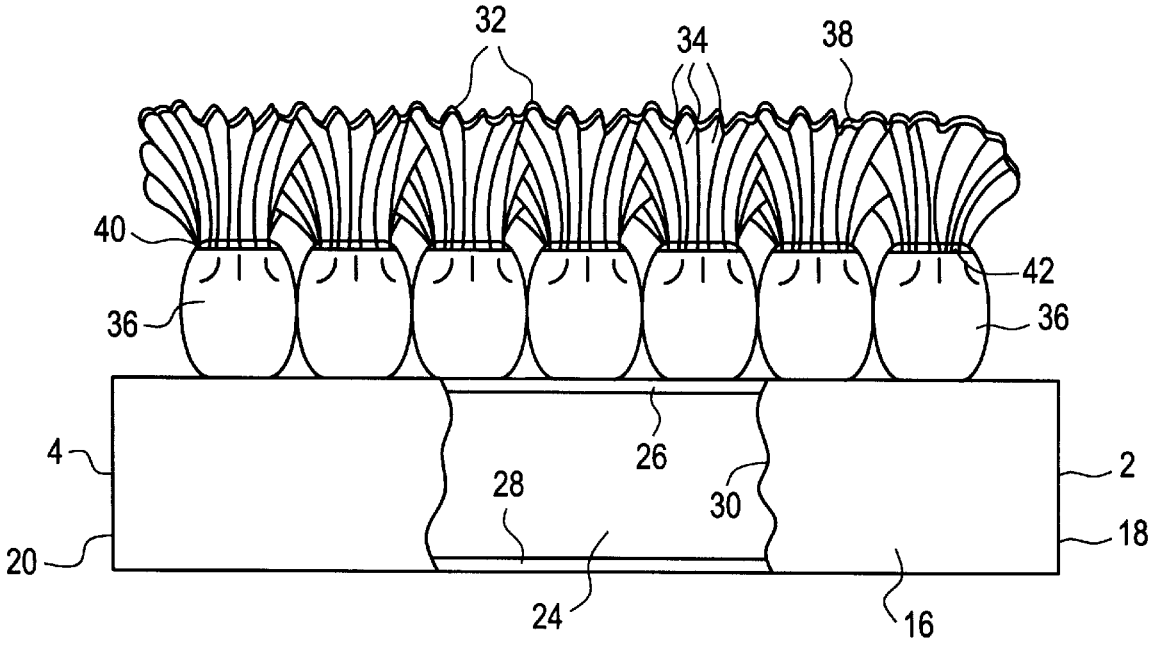
FIG. 4 is a side elevation view of the applicator showing the side opposite the one shown in FIG. 2.
Figure 5:
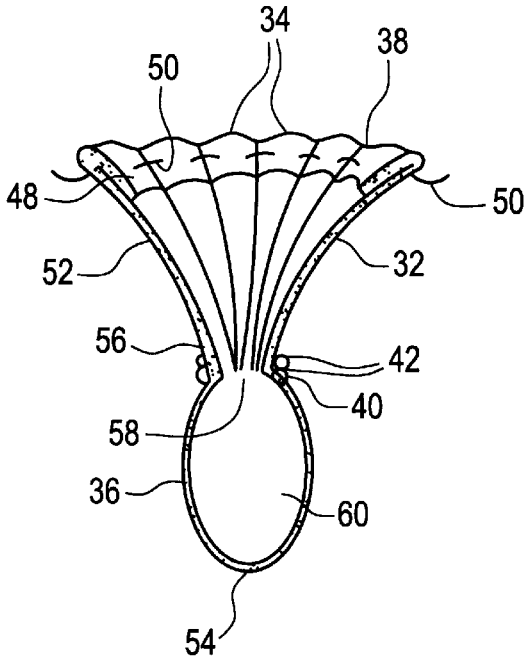
FIG. 5 is a section view of one of the cups or pods which make up the working portion of the applicator to more clearly illustrate the inner portions thereof.
Figure 6:
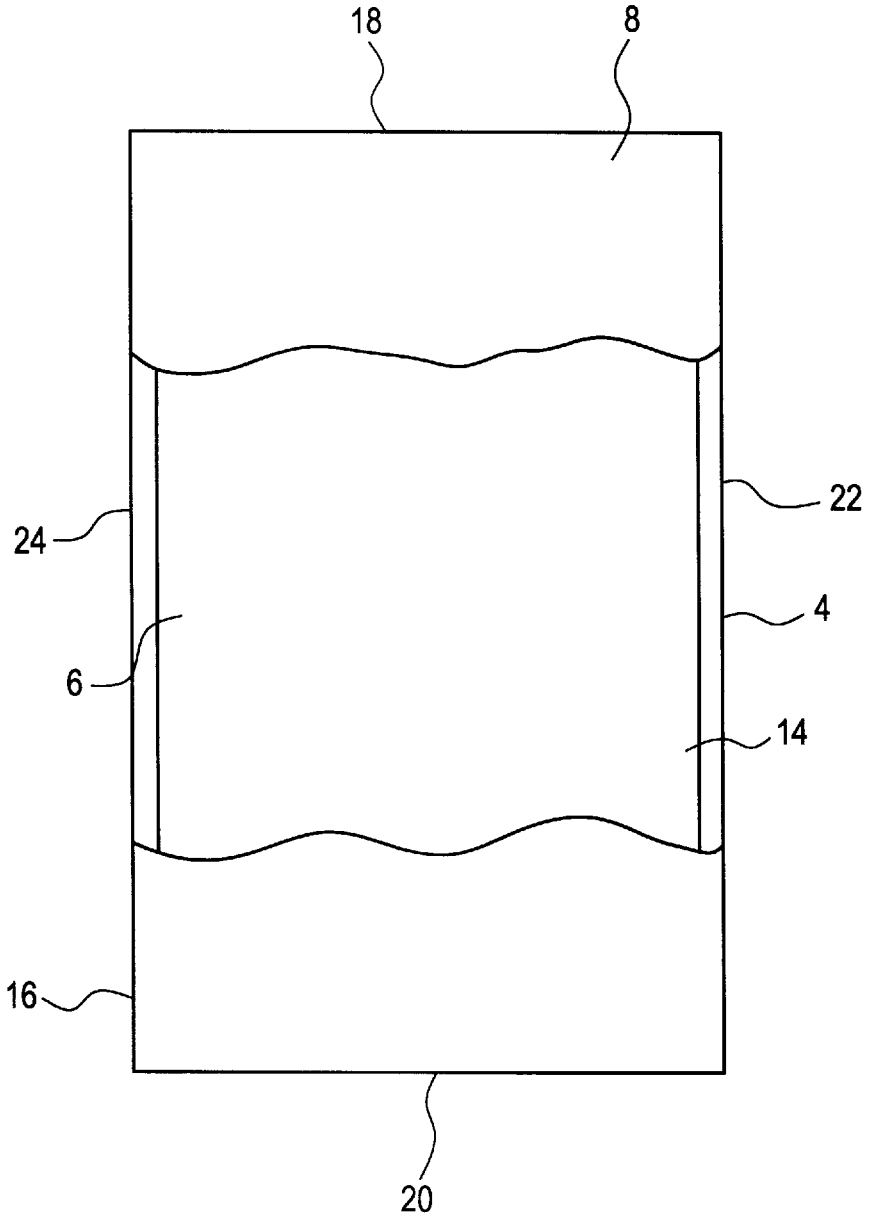
FIG. 6 is a bottom plan view of a paint applicator in accordance with this invention.

A paint applicator 2 in accordance with this invention comprises a body portion 4 of flexible resilient material such as a sponge 6 enclosed within a fabric cover 8.

The body portion 4 includes an upper wall 10 having a planar surface 12. The upper wall 10 as shown in the drawing has a rectangular peripheral configuration but its peripheral configuration may be circular, ovular, irregular or any other configuration desired.

The body portion 4 as shown and described herein also includes a rectangular lower wall 14 spaced apart from the upper wall 10 by a peripheral wall 16, comprising a first end wall 18, an opposite second end wall 20, a first side wall 22 and a second side wall 24. The lower wall 14 and peripheral wall 16 may be of other then rectangular configuration. The dimension of the body portion 4 is such that it will fit the hand of a user whereby it can be grasped and held in the user's hand during a painting operation. By way of example, the applicator 2 as shown and described herein has a body portion 4 that is about five inches long, about three inches wide, and about one inch in depth.

The fabric cover 8 comprises an upper fabric layer 26 covering the upper wall 10 of the body portion 4, a fabric layer 28 covering the body portion's lower wall 14, and a peripheral fabric layer 30 covering the body portion's peripheral wall 16.

A plurality of closely bunched together pods 32 of fabric material gathered into rather tight folds 34 are secured to the upper fabric layer 26 of the cover 8 by sewing or other means. The closely bunched pods 32 of rather tightly folded fabric material are sufficient in number to completely cover the planar upper wall 10 of the body portion 4. By way of example, the embodiment shown and described herein has twenty-eight pods 32 to cover the surface of the upper wall 10 and upper fabric layer 26. Since the length of the body portion 4 in the example given is five inches and its width three inches, the surface area of the upper wall 10 is fifteen square inches. Thus the density of the pods 32 in the example given of twenty-eight pods covering a fifteen square inch area is 1.87 or about two pods per square inch.

Each fabric pod 32 has a relatively small lower portion or fabric base 36 which is secured to the upper fabric layer 26 of the cover 8 by sewing in the embodiment shown and described herein. Each pod 32 flares outwardly as it extends upwardly from the fabric base, terminating at the upper free end 38 in a plurality of outwardly flaring folds 34 which are nevertheless held closely adjacent each other by a band 40 of thread or string 42 wound around each pod 32 between the lower end of the base 36 and the upper free end 38. Each pod 32 has about fourteen radial folds 34 in the embodiment shown for illustrative purposes, but the number of folds can be twenty or more. The number of folds 34 should be sufficient when drawn together by the band 40 to absorb and hold a quantity of paint when dipped into a paint container that is sufficient for a painter using the applicator in accordance with this invention to cover a larger surface area with paint before having to dip back into the paint applicator again, than prior art paint applicators of the pattern or design creating type, such as a crumpled rag.

The pods 32 in the embodiment of the invention shown and described herein are made by first cutting a piece of fabric to form a fabric circle 44 about six inches in diameter. The outer circumferential edge 46 is then folded over to form a circumferential fold over portion 48 extending inwardly about a quarter to three-fourths of an inch from the outer edge 46. The circumferential folded over portion 48 is then gathered into the radial folds 34, numbering between fourteen to twenty folds or more. A thread or string 50 is drawn through each successive radial fold around the circumferential fold over portion 48 using a needle, until the thread or string 50 has been extended through all of the radial folds. The thread or string 50 is then drawn up snugly to draw the radial folds 34 together in close side-by-side relationship.

When the radial folds of the outer edge 46 and fold over portion 48 are drawn together, the original fabric circle 44 forms a cup 52. The center portion 54 of the fabric circle 44 becomes the lower portion of the cup 52 and forms the fabric base 36 of the pod 32 as the thread 50 is drawn up to bring the radial folds 34 into closely adjacent side-by-side relationship.

In use, the folds 34 and cup 52 of the pods 32 absorb and fill with paint when dipped into a paint container. Paint is then applied to a surface area when the painter brushes the applicator 2 against the surface while applying enough pressure to squeeze and dispense paint from the folds 34 and cup 52 of the applicator pods to the surface being painted. The applicator 2 and the folds 34 of the applicator pods 32 in accordance with this invention enable the painter to provide a textured, patterned or designer type paint finish to the surface, resembling for example, a wall having wall paper thereon.

The body portion 4 has a lateral and longitudinal dimension corresponding to that of a user's hand. In use, the user's thumb grasps one side wall 22 or 24 and his fingers grasp the other opposite one.

The unique construction of the cup 52 enables each pod 32 to take up a greater supply of paint when dipped into a paint container than could be absorbed by folds of fabric or other absorbent material which had not been formed into a cup or pocket. The band 40 of thread or string around the mid-section 56 of each pod 32 about mid-way between the lower end of the base portion 36 and upper free end 38 is drawn up tighter than the thread or string 50 through the folded over portion 48 adjacent the upper free end 38. The mid-section 56 of each pod therefore has a smaller diameter than the circumferential folded over portion 48, and a restricted passageway 58 through the mid-section 56 into the lower chamber or pocket 60 of the cup 52. The lower chamber or pocket 60 of each pod fills with paint when the applicator 2 is dipped into a paint container, partly by absorption through the fabric wall of the chamber or pocket 60 and partly by flowing therein through the restricted passageway 58. When the painter is applying paint to the suface being painted, the restricted passageway 58 and its surrounding band 40 serve as a limit or control valve to dispense paint from the reservoir pocket or chamber 60 of each pod in a limited and controlled flow depending on the application pressure applied by the painter.

I claim:

1. An applicator comprising a body portion for a user to hold and a working portion for applying a substance to a surface area, said working portion having a contact surface which extends longitudinally and laterally, all parts of which face toward the surface to be contacted with the substance when said applicator is held in position to apply the substance to said surface, said working portion including absorbing means to absorb a quantity of the substance to be applied to a surface area, and design forming means to form one or more designs in said substance when applied to a said surface area, wherein said absorbing means of said working portion includes a plurality of compressible absorbent members arranged in close side-by-side relationship, wherein each of said compressible absorbent members terminates outwardly in a free end coterminous with said contact surface of said working portion, said design forming means of said working portion comprising folds of each of said compressible absorbent members extending from said free ends thereof and inwardly thereof from said free ends, wherein said compressible absorbent members are made of a fabric material, wherein each of said compressible absorbent members includes a peripheral band extending therearound at a location spaced apart inwardly from said free ends thereof, said folds of each of said compressible absorbent members flaring outwardly as they extend upwardly from said location of said peripheral band toward said free ends thereof.

2. An applicator as set forth in claim 1, wherein said body portion includes a substantially planar upper wall, a layer of flexible sheet material covering said substantially planar upper wall, said compressible absorbent members each having a securable end opposite from said free ends thereof, each of said securable ends of said compressible absorbent members being secured to said layer of flexible sheet material.

3. An applicator comprising a body portion and a working portion, said working portion including a plurality of compressible absorbent members having folds therein, wherein said folds of a one of said compressible absorbent members comprises a circular piece of flexible sheet material having an outer circumferential free edge, said free edge folded over around the circumference of said circular piece of flexible sheet material to form a folded over circumferential portion, said folded over circumferential portion being gathered into a plurality of radial folds extending radially inward of said circular piece of flexible sheet material, a thread extending circumferentially around said folded over circumferential portion, through each of said radial folds thereof and drawn up snug to position and hold said radial folds in close side-by-side relationship.

4. An applicator as set forth in claim 3, wherein each of said compressible absorbent members extend from said folded over circumferential portion thereof radially inward toward the center of said circular piece of flexible sheet material, said circular piece of flexible sheet material extends longitudinally from said folded over circumferential portion when said radial folds thereof are gathered together in side-by-side relationship to terminate in a securable end, said securable end of each of said compressible absorbent members being secured to said body portion of said applicator.

5. An applicator as set forth in claim 4, including a band around each of said compressible absorbent members at a location between said securable end thereof and said folded over circumferential portion thereof.

6. An applicator as set forth in claim 5, wherein each of said compressible absorbent members flare outwardly as they extend upwardly from said location of said band toward said folded over circumferential portion.

7. An applicator as set forth in claim 3, wherein said circular piece of flexible sheet material is a fabric material.

8. An applicator comprising a body portion for a user to hold and a working portion for applying a substance to a surface area, said working portion including absorbing means to absorb a quantity of the substance to be applied to a surface area, wherein said absorbing means includes an absorbent flexible sheet cup member, wherein said absorbent flexible sheet cup member is made of an absorbent fabric material, wherein said absorbent flexible sheet cup member includes an outer free end, a lower securable end securable to said body portion, said cup member having a peripheral wall formed into a plurality of folds and flaring outwardly as said peripheral wall and folds extend outwardly toward said outer free end, wherein said absorbent flexible sheet cup member includes a peripheral band around its peripheral wall at a location between said outer free end and said lower securable end, said band drawing said peripheral wall of said absorbent flexible sheet cup member into a relatively small dimension cross-section, a restricted passageway of said cup member at said location of said peripheral band having a relatively small cross-sectional dimension, said cup member having an entrance opening at its said outer free end, the cross-sectional dimension of said entrance opening being greater than said cross-sectional dimension of said restricted passageway, the portion of said absorbent flexible cup member between said location of said peripheral band and said lower securable end of said cup member having a cross-sectional dimension greater than that of said restricted passageway to provide a reservoir portion of said cup member to receive a said substance therein and to flow said substance outwardly through said restricted passageway when said applicator is applying said substance to a said surface area.

* * * * *